US012070654B2

(12) United States Patent
Gopalakrishnan et al.

(10) Patent No.: US 12,070,654 B2
(45) Date of Patent: Aug. 27, 2024

(54) STUMP DEVICE FOR FEATURE ESTIMATION OF CRICKET GAMES

(71) Applicant: RAPSODO PTE. LTD., Singapore (SG)

(72) Inventors: Roshan Gopalakrishnan, Singapore (SG); Saurabh Garg, Singapore (SG); Lodiya Radhakrishnan Vijayanand, Singapore (SG); Batuhan Okur, Singapore (SG)

(73) Assignee: Rapsodo Pte. Ltd., Singapore (SG)

( * ) Notice: Subject to any disclaimer, the term of this patent is extended or adjusted under 35 U.S.C. 154(b) by 251 days.

(21) Appl. No.: 17/747,711

(22) Filed: May 18, 2022

(65) Prior Publication Data

US 2023/0372776 A1 Nov. 23, 2023

(51) Int. Cl.
*A63B 102/20* (2015.01)
*A63B 24/00* (2006.01)

(52) U.S. Cl.
CPC .. *A63B 24/0021* (2013.01); *A63B 2024/0025* (2013.01); *A63B 2102/20* (2015.10); *A63B 2220/10* (2013.01); *A63B 2220/80* (2013.01)

(58) Field of Classification Search
CPC ..... A63B 2102/20; A63B 2220/89
See application file for complete search history.

(56) References Cited

U.S. PATENT DOCUMENTS 9,555,284 B2 * 1/2017 Vollbrecht ..... A63B 24/0021
10,596,416 B2 * 3/2020 Forsgren ..... G01S 13/587
10,721,384 B2 * 7/2020 Schwager ..... H04N 23/72
10,898,757 B1 * 1/2021 Johansson ..... G01S 13/867
10,989,791 B2 * 4/2021 Tuxen ..... G01S 13/536
2009/0067670 A1 3/2009 Johnson et al.
2011/0286632 A1 11/2011 Tuxen et al.
2017/0054950 A1 2/2017 Yeo et al.
2018/0156914 A1 6/2018 Tuxen et al.
(Continued)

FOREIGN PATENT DOCUMENTS

GB 2 274 756 A 8/1994
WO 2012/027776 A1 3/2012
WO 2018/076065 A1 5/2018

OTHER PUBLICATIONS

AU Patent Examination Report No. 1 dated Aug. 2, 2023 as received in Application No. 2022211821.
(Continued)

*Primary Examiner* — Jay Trent Liddle
(74) *Attorney, Agent, or Firm* — Fish & Richardson P.C.

(57) ABSTRACT

A stump device may include a first image-capturing sensor configured to couple to at least one stump of a wicket positioned at a bowling end of a cricket field and capture image data of an initial motion of a cricket ball. The stump device may also include a second image-capturing sensor configured to couple to at least one stump of the wicket and capture image data of a trajectory and a flight path of the cricket ball. The stump device may additionally include a first radar sensor configured to couple to at least one stump of the wicket and capture radar data describing one or more initial launch parameters of the cricket ball. The stump device may include a second radar sensor configured to couple to at least one of the stumps of the wicket and capture radar data describing one or more movement parameters of a bowler.

20 Claims, 4 Drawing Sheets

(56) References Cited

U.S. PATENT DOCUMENTS

| | | | | |
|---|---|---|---|---|
| 2018/0272221 | A1* | 9/2018 | Sundararajan | G09B 9/00 |
| 2019/0347956 | A1* | 11/2019 | Daga | G16H 40/67 |
| 2019/0391254 | A1 | 12/2019 | Asghar et al. | |
| 2020/0298092 | A1 | 9/2020 | Okur et al. | |
| 2022/0343514 | A1* | 10/2022 | Jayaram | G06T 7/248 |
| 2022/0345660 | A1* | 10/2022 | Jayaram | G06T 7/73 |
| 2022/0401841 | A1* | 12/2022 | Ghanchi | A63F 13/65 |
| 2023/0100572 | A1* | 3/2023 | Jayaram | G06T 19/00 345/419 |
| 2023/0196770 | A1* | 6/2023 | Anton | G06F 3/16 382/103 |
| 2023/0372775 | A1 | 11/2023 | Gopalakrishnan et al. | |

OTHER PUBLICATIONS

United Kingdom search report issued in corresponding application No. 2209411.4, dated Dec. 28, 2022.

Hawkeye Innovations, hawkeyeinnovations.com/our-technology (retrieved May 18, 2022).

myball.Biz, https://myball.biz/ (retrieved May 18, 2022).

Trackman, www.trackman.com/golf/trackman-4 (retrieved May 18, 2022).

Products.pitchvision.com [online], "Pitch Vision," available on or before May 17, 2022, via Internet Archive: Wayback Machine URL <https://web.archive.org/web/20220517074817/products.pitchvision.com/product/pv-one/>, retrieved on May 8, 2024, URL<products.pitchvision.com/product/pv-one/>, 8 pages.

* cited by examiner

STUMP DEVICE FOR FEATURE ESTIMATION OF CRICKET GAMES

The present disclosure generally relates to estimating features of cricket games using a stump device.

BACKGROUND

A game of cricket may include a cricket field that has a bowling end, a cricket pitch, and a batting end. A first wicket including three stumps may be positioned at the bowling end, and a second wicket may be positioned at the batting end. A bowler may pitch a cricket ball from the bowling end towards the second wicket at the batting end, and a batter positioned in front of the second wicket at the batting end may hit the pitched cricket ball using a cricket bat.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

According to an aspect of an embodiment, a stump device may include a first image-capturing sensor configured to couple to at least one stump of a wicket positioned at a bowling end of a cricket field and capture image data of an initial motion of a cricket ball. The stump device may also include a second image-capturing sensor configured to couple to at least one stump of the wicket and capture image data of a trajectory and a flight path of the cricket ball. The stump device may additionally include a first radar sensor configured to couple to at least one stump of the wicket and capture radar data describing one or more initial launch parameters of the cricket ball. The stump device may include a second radar sensor configured to couple to at least one of the stumps of the wicket and capture radar data describing one or more movement parameters of a bowler.

In these and other embodiments, a system may include the stump device as described above. The system may also include a processor configured to process the image data captured by the first image-capturing sensors and the second image-capturing sensors and the radar data captured by the first radar sensors.

The object and advantages of the embodiments will be realized and achieved at least by the elements, features, and combinations particularly pointed out in the claims. It is to be understood that both the foregoing general description and the following detailed description are explanatory and are not restrictive of the invention, as claimed.

BRIEF DESCRIPTION OF THE DRAWINGS

Example embodiments will be described and explained with additional specificity and detail through the accompanying drawings in which.

DETAILED DESCRIPTION

Analyzing three-dimensional motion of an object, such as a cricket ball or a cricket bat, and/or players, in cricket games may be beneficial for form and/or technique training, umpiring decisions, and/or gameplay analysis. Radar technology may be used to detect and track the motion of the object and/or the players in cricket games. The radar technology may be used to measure various parameters of the object and/or the player such as a position, a direction of movement, a speed, and/or a velocity of the object and/or the player. Additionally, camera-based systems may be used to capture images of the object and/or the player such that motion of the object and/or the player may be correlated with images of the object and/or the player.

Existing motion-detection systems used in cricket games may be difficult to set up on a particular cricket field and include various disadvantages. Such motion-detection systems may be unwieldy, include numerous components, and/or be highly complex to set up. For example, some motion-detection systems, such as a HAWK-EYE system, use multiple cameras (e.g., ten or more cameras) installed in the cricket field to capture images of a cricket game. As another example, motion-detection systems, such as a PITCHVISION system, employ ground-based sensor mats to determine and analyze important parameters associated with motion of the cricket ball, such as a pitching point on the ground, a length of a bowled delivery of the cricket ball, a bounce of the cricket ball, etc. As such, existing motion-detection systems for cricket may not provide a holistic three-dimensional representation of the motion of the bowler and/or the cricket ball in a manner that complies with the rules of cricket.

The present disclosure may relate to, among other things, a stump device configured to capture radar data and image data relating to motion of one or more objects in a cricket game, such as a cricket ball and/or players in the cricket game. The combination of radar data and image data captured by the stump device may provide a more holistic representation of the motion of the objects during training and/or live cricket games relative to existing motion-detection and/or analysis systems. Additionally or alternatively, the stump device may be a less cumbersome system of motion detection and/or analysis relative to existing systems. As such, the stump device may provide a low-cost and/or less intrusive system of motion detection and/or analysis for cricket.

Embodiments of the present disclosure are explained with reference to the accompanying figures.

Figure 1:
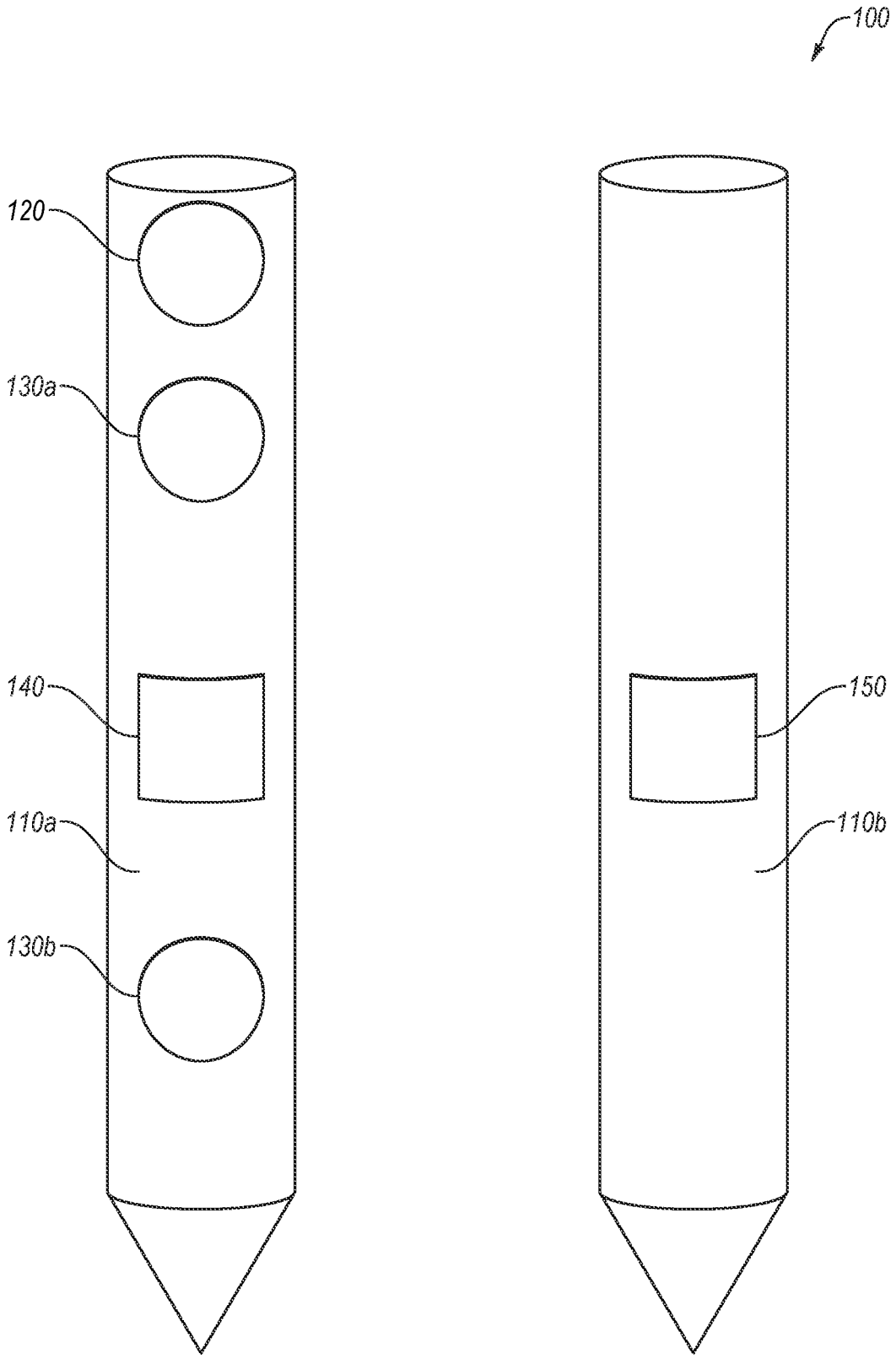
FIG. 1 illustrates an example embodiment of a stump device according to the present disclosure.

FIG. 1 illustrates an example embodiment of a stump device 100 according to the present disclosure. In some embodiments, the stump device 100 may include a front side 110*a* that includes one or more mono image-capturing sensors 120, one or more pairs of stereo image-capturing sensors 130 (e.g., stereo image-capturing sensors 130*a* and 130*b*), and/or one or more front-facing radar sensors 140. Additionally or alternatively, the stump device 100 may include a back side 110*b* to which a back-facing radar sensor 150 is coupled.

In some embodiments, the stump device 100 may be configured to obtain image data and/or radar data at a designated framerate. For example, the stump device 100 may be configured to capture an image and/or sample radar data once per second, once per ten seconds, once per thirty seconds, once per minute, etc. Increasing the framerate of the stump device 100 may improve the accuracy of modeling the motion of a bowler and/or a cricket ball and/or facilitate capturing more details about the motion of the moving objects, while decreasing the framerate of the stump device 100 may reduce power consumption of the cricket sensor 100. In these and other embodiments, the framerate of the stump device 100 may be designated based on user input. Additionally or alternatively, the framerate of the stump device 100 may be controlled by a processor based on operation of the stump device 100. For example, a particular processor may be configured to increase the framerate of a particular stump device in response to determining an insufficient amount of image data and/or radar data is being obtained by the particular stump device. In this example, the particular processor may be configured to decrease the framerate of the particular stump device in situations in which the processor determines energy should be conserved (e.g., when a battery providing energy to the particular stump device is running low).

The image-capturing sensors 120 and/or 130 may include any device, system, component, or collection of components configured to capture images. The image-capturing sensors 120 and/or 130 may include optical elements such as, for example, lenses, filters, holograms, splitters, etc., and an image sensor upon which an image may be recorded. Such an image sensor may include any device that converts an image represented by incident light into an electronic signal. The image sensor may include a plurality of pixel elements, which may be arranged in a pixel array (e.g., a grid of pixel elements); for example, the image sensor may comprise a charge-coupled device (CCD) or complementary metal-oxide-semiconductor (CMOS) image sensor. The pixel array may include a two-dimensional array with an aspect ratio of 1:1, 4:3, 5:4, 3:2, 16:9, 10:7, 6:5, 9:4, 17:6, etc., or any other ratio. The image sensor may be optically aligned with various optical elements that focus light onto the pixel array, for example, a lens. Any number of pixels may be included such as, for example, eight megapixels, 15 megapixels, 20 megapixels, 50 megapixels, 100 megapixels, 200 megapixels, 600 megapixels, 1000 megapixels, etc.

The image-capturing sensors 120 and/or 130 may operate at certain framerates or be able to capture a certain number of images in a particular period of time. The image-capturing sensors 120 and/or 130 may operate at a framerate of greater than or equal to about 30 frames per second. In a specific example, image-capturing sensors 120 and/or 130 may operate at a framerate between about 100 and about 300 frames per second. In some embodiments, a smaller subset of the available pixels in the pixel array may be used to allow for the image-capturing sensors 120 and/or 130 to operate at a higher framerate; for example, if a moving object is known or estimated to be located in a certain quadrant, region, or space of the pixel array, only that quadrant, region, or space may be used in capturing the image allowing for a faster refresh rate to capture another image. Using less than the entire pixel array may allow for the use of less-expensive image-capturing sensors while still enjoying a higher effective framerate.

Various other components may also be included in the image-capturing sensors 120 and/or 130. Such components may include one or more illuminating features such as a flash or other light source, a light diffuser, or other components for illuminating an object. In some embodiments, the illuminating features may be configured to illuminate the moving object when it is proximate the image sensor, for example, when the moving object is within three meters of the image sensor.

The radar sensors 140 and/or 150 may include any system, component, or series of components configured to transmit one or more microwaves or other electromagnetic waves towards a moving object (e.g., a bowler and/or a pitched cricket ball) and receive a reflection of the transmitted microwaves back, reflected off of the moving object. The radar sensors 140 and/or 150 may include a transmitter and a receiver. The transmitter may transmit a microwave through an antenna towards the moving object. The receiver may receive the microwave reflected back from the moving object. The radar sensors 140 and/or 150 may operate based on techniques of Pulsed Doppler, Continuous Wave Doppler, Frequency Shift Keying Radar, Frequency Modulated Continuous Wave Radar, or other radar techniques as known in the art. The frequency shift of the reflected microwave may be measured to derive a radial velocity of the moving object, or in other words, to measure the speed at which the moving object is traveling towards the radar sensors 140 and/or 150. The radial velocity may be used to estimate the speed of the moving object, the velocity of the moving object, the distance between the moving object and the radar sensors 140 and/or 150, the frequency spectrum of the moving object, etc.

The radar sensors 140 and/or 150 may also include any of a variety of signal processing or conditioning components; for example, the radar sensors 140 and/or 150 may include an analog frontend amplifier and/or filters to increase the signal-to-noise ratio (SNR) by amplifying and/or filtering out high frequencies or low frequencies, depending on the moving object and the context in which the radar sensors 140 and/or 150 is being used. In some embodiments, the signal processing or conditioning components may separate out low and high frequencies and may amplify and/or filter the high frequencies separately and independently from the low frequencies. In some embodiments, the range of motion of the object may be a few meters to tens of meters, and thus, the radar bandwidth may be narrow.

Because the stump device 100 is included as part of the wicket, which may be stricken by cricket balls, cricket bats, players, etc., the sensors coupled to the stump device 100 may include protective features that reduce the damage caused to the sensors by physical contact and/or other impact forces. In some embodiments, the sensors included with the stump device 100 may include one or more bumpers to reduce the force applied to the sensors of the stump device 100 when the wicket is knocked down during the course of a cricket game. Additionally or alternatively, the sensors may be protected by a transparent (e.g., plastic and/or glass) cover.

In these and other embodiments, the sensors of the stump device 100 may be quickly and/or frequently calibrated to compensate for frequent displacement of the stump device 100 during the course of a cricket game and/or during a training session. In some embodiments, the sensors may be calibrated in terms of orientation, location, and/or any other physical parameters at fixed intervals (e.g., every ten seconds, every thirty seconds, etc.) to address the frequent displacement of the stump device 100. For example, a visual cue or a key point in a field of view of a particular camera may include field markings on the cricket field, stumps at either end of the cricket pitch, off-field objects (e.g., bleachers, spectator boxes, stadium walls, etc.), or any other objects that may be detected by the particular camera may be used as reference points for calibrating the particular camera relative to one or more aspects of the cricket game despite frequent displacement of the particular camera. Additionally or alternatively, the sensors may be calibrated after not capturing sensor data relating to a bowler, a cricket ball, and/or any other objects for a particular period of time. Additionally or alternatively, the sensors may be calibrated in response to capturing particular patterns of sensor data that represent setting up the wicket. Additionally or alternatively, the sensors may be calibrated manually (remotely and/or physically) by a user.

In some embodiments, the amount of space available on a particular stump may be insufficient for including all of the above-referenced sensors on the same stump (e.g., as part of a single stump device 100). Additionally or alternatively, stumps used in official cricket games must be made of wood, which may constrain sensor placements on the same stump device 100. Thus, although the mono image-capturing sensors 120, the stereo image-capturing sensors 130, the front-facing radar sensors 140, and the back-facing radar sensor 150 are illustrated as being included on the same stump device 100, each of the above-referenced sensors may be included on the same and/or different stump devices.

Figure 2:
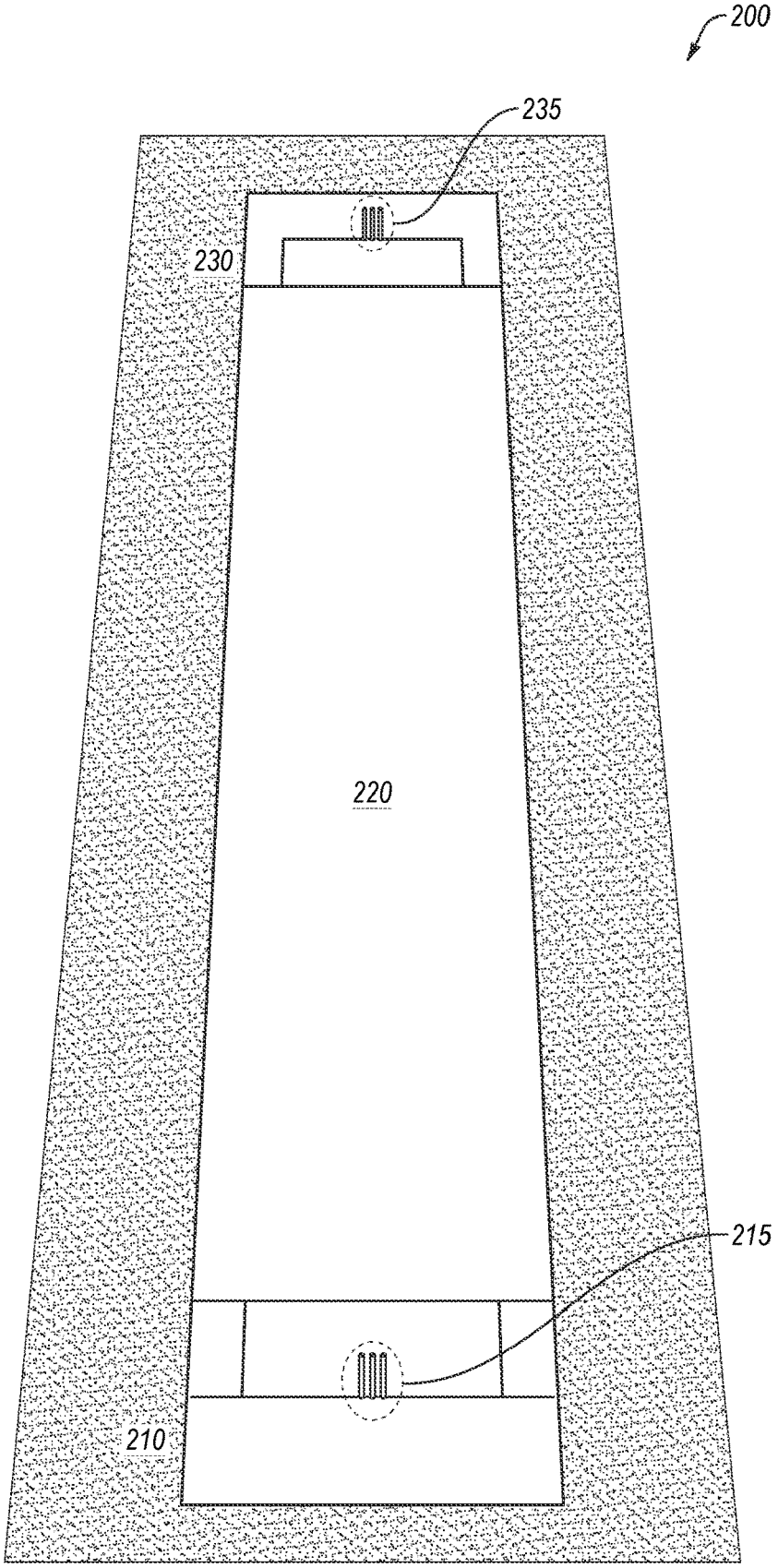
FIG. 2 illustrates a cricket field that includes the stump device according to the present disclosure positioned on a wicket included on the cricket field.

For example, FIG. 2 illustrates a cricket field 200 that includes the stump device 100 according to the present disclosure positioned on a wicket 215 included on the cricket field 200. In some embodiments, the cricket field 200 may include a first end (e.g., a bowling end 210) and a second end (e.g., a batting end 230) separated by a cricket pitch 220. The wicket 215 may be a wicket located at the bowling end 210, and a second wicket 235 may be located at the batting end 230 of the cricket field 200. The mono image-capturing sensors 120 and the front-facing radar sensors 140 may be included as part of a first stump device, and the stereo image-capturing sensors 130 and the back-facing radar sensor 150 may be included as part of a second stump device in which both the first stump device and the second stump device are included as part of the same wicket (e.g., as part of the wicket 215). Additionally or alternatively, the above-referenced sensors may be included on one or more stump devices of different wickets (e.g., with some sensors included as part of the wicket 215 and other sensors included as part of the wicket 235).

In these and other embodiments, the different stumps and/or the different wickets on which the mono image-capturing sensors 120, the stereo image-capturing sensors 130, the front-facing radar sensors 140, and/or the back-facing radar sensor 150 may be positioned may be communicatively coupled with each other to facilitate synchronization of the sensor data capture. For example, the stumps and/or wickets may be configured to wirelessly communicate via an optical communication device, an infrared communication device, a wireless communication device (such as an antenna), and/or chipset (such as a Bluetooth device, an 802.6 device (e.g., Metropolitan Area Network (MAN)), a WiFi device, a WiMax device, an LTE device, an LTE-A device, cellular communication facilities, or others), and/or the like. Additionally or alternatively, the sensors included on a particular stump and/or wicket may include different specifications to more effectively capture sensor data. As an example with reference to the cricket field 200 illustrated in FIG. 2, a system of sensors configured to capture motion information about a bowler and a cricket ball pitched from the bowling end may include some sensors coupled to the wicket 215 at the bowling end 210 and some sensors coupled to the wicket 235 at the batting end 230. Because the sensors are configured to capture information from the bowler and/or the cricket ball at the bowling end 210, the sensors coupled to the wicket 235 at the batting end 230 may include specifications that facilitate longer range data capture, such as long-range focal lenses for the image-capturing sensors.

In some embodiments, the mono image-capturing sensors 120, the stereo image-capturing sensors 130, the front-facing radar sensors 140, and/or the back-facing radar sensor 150 may be installed externally on one or more surfaces of the stump device 100. For example, the sensors 120-150 may be configured to couple to an exterior surface of the stump device 100, such as via an adhesive, a strap, and/or any other coupling mechanisms. Additionally or alternatively, the stump device 100 may include a hollow interior and/or one or more cutout portions such that the above-referenced sensors may be installed internally inside the stump device 100. In these and other embodiments, the stump device 100 may be made of materials such as metal (e.g., aluminum, steel, etc.), plastic (e.g., polyvinyl chloride, high-density polyethylene, etc.), wood, and/or any other material such that portions of the stump device 100 may be hollowed for installation of one or more sensors.

Modifications, additions, or omissions may be made to the stump device 100 without departing from the scope of the disclosure. The designation of different elements in the manner described is meant to help explain concepts described herein and is not limiting. For example, elements of the stump device 100 may be implemented within other systems or contexts than those described. For example, the mono image-capturing sensors 120, the stereo image-capturing sensors 130, the front-facing radar sensors 140, and/or the back-facing radar sensor 150 may be positioned on different surfaces of the stump device 100 and/or be oriented in different directions than those described.

Figure 3:
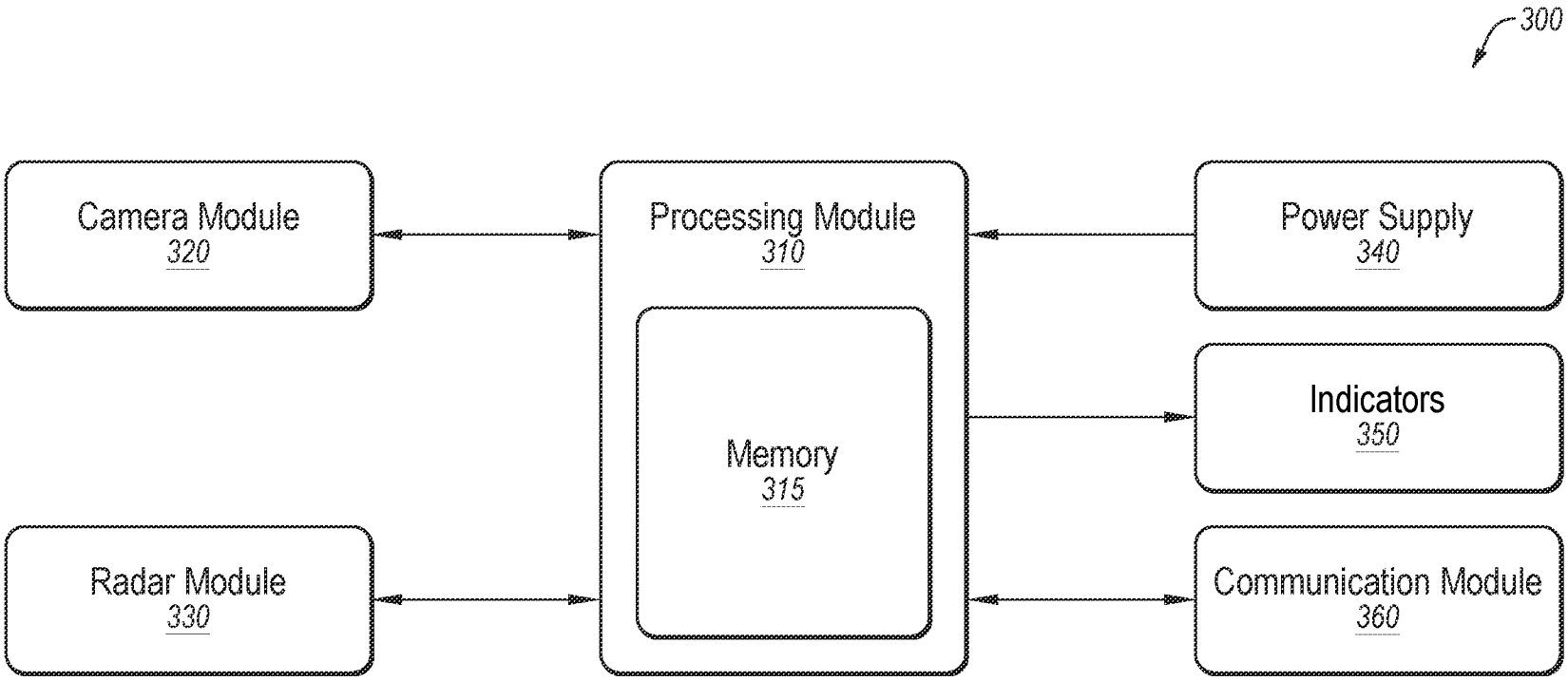
FIG. 3 is a diagram illustrating an example embodiment of a computing system configured to analyze three-dimensional motion of a bowler and/or a cricket ball according to the present disclosure.

FIG. 3 is a diagram illustrating an example embodiment of a computing system 300 configured to analyze three-dimensional motion of a bowler and/or a cricket ball according to the present disclosure. The computing system 300 may include a processing module 310, memory 315, a camera module 320, a radar module 330, a power supply 340, one or more indicators 350, and/or a communication module 360. Any or all of the stump device 100 of FIG. 1 may be implemented as a computing system consistent with the computing system 300.

Generally, the processing module 310 may include any suitable computer, computing entity, or processing device including various computer hardware or software modules and may be configured to execute instructions stored on any applicable computer-readable storage media. For example, the processing module 310 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data.

Although illustrated as a single unit in FIG. 3, it is understood that the processing module 310 may include any number of processing modules distributed across any number of network or physical locations that are configured to perform individually or collectively any number of operations described in the present disclosure. In some embodiments, the processing module 310 may interpret and/or execute program instructions and/or process data stored in the memory 315, the camera module 320, and/or the radar module 330. In some embodiments, the processing module 310 may fetch program instructions from a data storage and load the program instructions into the memory 315.

Figure 4:
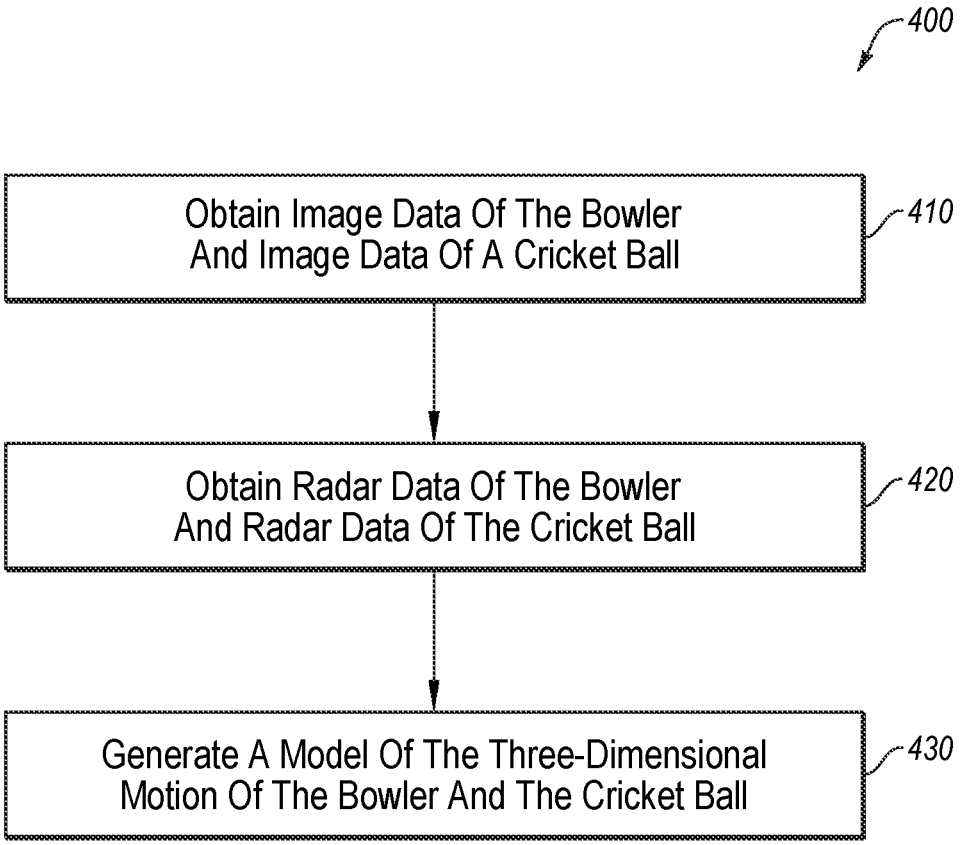
FIG. 4 is a flowchart of an example method of capturing sensor data associated with motion of a bowler and/or a cricket ball using the stump device according to the present disclosure.

After the program instructions are loaded into the memory 315, the processing module 310 may execute the program instructions, such as instructions to perform the method 400 of FIG. 4. For example, the processing module 310 may capture image data associated with a moving object, capture radar data associated with the same moving object, pair each image datum with a corresponding radar datum, and/or generate one or more three-dimensional motion representations of the moving object.

The memory 315 may include computer-readable storage media or one or more computer-readable storage mediums for carrying or having computer-executable instructions or data structures stored thereon. Such computer-readable storage media may be any available media that may be accessed by a computer, such as the processing module 310. For example, the memory 315 may store obtained image data and/or radar data.

By way of example, and not limitation, such computer-readable storage media may include non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a computer. Combinations of the above may also be included within the scope of computer-readable storage media. Computer-executable instructions may include, for example, instructions and data configured to cause the processing module 310 to perform a certain operation or group of operations.

In some embodiments, the camera module 320 may be communicatively coupled with the mono image-capturing sensors 120 and/or the stereo image-capturing sensors 130, and the radar module 330 may be communicatively coupled with the front-facing radar sensors 140 and/or the back-facing radar sensor 150. In these and other embodiments, the camera module 320 and/or the radar module 330 may be configured to pre-process the sensor data collected by the image sensors and/or the radar sensors, respectively, and provide the pre-processed sensor data to the processing module 310 for data analysis. For example, the camera module 320 and/or the radar module 330 may analyze and revise the obtained image data and/or radar data prior to providing the data to the processing module 310. In some embodiments, pre-processing of the sensor data may include identifying and removing erroneous data. Image data and/or radar data obtained by the stump device 100 including impossible data values (e.g., negative speed detected by a radar unit), improbable data values, noisy data, etc. may be deleted by the camera module 320 and/or the radar module 330 such that the deleted data is not obtained by the processing module 310. Additionally or alternatively, the image data and/or radar data may include missing data pairings in which an image captured at a particular point in time has no corresponding radar data or vice versa; such missing data pairings may be deleted during data pre-processing. In these and other embodiments, the image data pre-processing and/or the radar data pre-processing may include converting the data obtained by the stump device 100 into a format that the processing module 310 may use for analysis of the pre-processed image data and/or radar data.

In some embodiments, the power supply 340 may include one or more batteries and one or more charging interfaces corresponding to the batteries. For example, the batteries may be rechargeable batteries, and the charging interface may include a charging port, a solar panel, and/or any other interface for charging the batteries. Additionally or alternatively, the batteries may not be rechargeable (e.g., disposable batteries), and the power supply 340 may not include a charging interface.

In some embodiments, the indicators 350 may include a graphical user interface (GUI) that allows a user to better understand, calibrate, and/or otherwise use the stump device 100. For example, the indicators 350 may be displayed on a LED screen and report system levels and/or stages for radar data capture triggers, image data capture triggers, device battery life, latest recorded parameters, and/or any other stats relating to operation of the stump device 100.

The communication module 360 may include any component, device, system, or combination thereof that is configured to transmit or receive information over a network. In some embodiments, the communication module 360 may communicate with other devices at other locations, the same location, or even other components within the same system. For example, the communication module 360 may include a modem, a network card (wireless or wired), an optical communication device, an infrared communication device, a wireless communication device (such as an antenna), and/or chipset (such as a Bluetooth device, an 802.6 device (e.g., Metropolitan Area Network (MAN)), a WiFi device, a WiMax device, an LTE device, an LTE-A device, cellular communication facilities, or others), and/or the like. The communication module 360 may permit data to be exchanged with a network and/or any other devices or systems described in the present disclosure. For example, the communication module 360 may allow the system 300 to communicate with other systems, such as computing devices and/or other networks.

FIG. 4 is a flowchart of an example method 400 of capturing sensor data associated with motion of a bowler and/or a cricket ball using the stump device according to the present disclosure. The method 400 may be performed by any suitable system, apparatus, or device, including by processing logic that may be hardware, software, or a combination of hardware and software. For example, the stump device 100 and/or the computing system 300 may perform one or more of the operations associated with the method 400. Although illustrated with discrete blocks, the steps and operations associated with one or more of the blocks of the method 400 may be divided into additional blocks, combined into fewer blocks, or eliminated, depending on the particular implementation.

The method 400 may begin at block 410, where processing logic may obtain image data of the bowler and/or image data of a cricket ball. At block 420, the processing logic may obtain radar data of the bowler and/or radar data of the cricket ball. In some embodiments, obtaining the image data at block 410 and obtaining the radar data at block 420 may occur simultaneously because the image data and the radar data may be captured simultaneously by image-capturing sensors and radar sensors, respectively, of a stump device, such as the stump device 100 described above in relation to FIG. 1.

At block 430, the processing logic may generate a model of three-dimensional motion of the bowler and/or of the cricket ball. In some embodiments, the image data corresponding to a bowler and/or a cricket ball at a particular point in time may be paired with radar data corresponding to the same bowler and/or the same cricket ball at the same particular point in time. Pairing the image data and the radar data corresponding to the same bowler and/or the same cricket ball may provide information beyond either the image data or the radar data alone could describe. For example, the image data alone may only provide a two-dimensional representation of the bowler and/or the cricket ball. As another example, the radar data alone may only provide descriptions of motion with little or no context regarding visual modeling of the bowler and/or the cricket ball. In these and other embodiments, the paired image and radar data may be combined as a function of time such that a motion representation of the bowler and/or the cricket ball may be depicted over the time period in which the radar data and the image data were captured. Additionally or alternatively, a machine-learning model and/or any other data-processing system may extrapolate the motion of the bowler and/or the cricket ball beyond the time period in which the data were captured and generate a predictive three-dimensional model of the motion of the bowler and/or the cricket ball.

Modifications, additions, or omissions may be made to the operations of the method 400 without departing from the scope of the disclosure. For example, the designations of different elements in the manner described is meant to help explain concepts described herein and is not limiting. Further, the operations of the method 400 may include any number of other elements or may be implemented within other systems or contexts than those described.

One skilled in the art, after reviewing this disclosure, may recognize that modifications, additions, or omissions may be made to the system 300 without departing from the scope of the present disclosure. For example, the system 300 may include more or fewer components than those explicitly illustrated and described.

The embodiments described in the present disclosure may include the use of a computer including various computer hardware or software modules. Further, embodiments described in the present disclosure may be implemented using computer-readable media for carrying or having computer-executable instructions or data structures stored thereon.

Terms used in the present disclosure and especially in the appended claims (e.g., bodies of the appended claims) are generally intended as "open terms" (e.g., the term "including" should be interpreted as "including, but not limited to.").

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is expressly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase preceding two or more alternative terms, whether in the description, claims, or drawings, should be understood to contemplate the possibilities of including one of the terms, either of the terms, or both of the terms. For example, the phrase "A or B" should be understood to include the possibilities of "A" or "B" or "A and B."

All examples and conditional language recited in the present disclosure are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. A sensor device comprising:

a first image-capturing sensor coupled to a wicket positioned at a bowling end of a cricket field and configured to capture image data of an initial motion of a cricket ball;

a second image-capturing sensor coupled to the wicket and configured to capture image data of a trajectory and a flight path of the cricket ball;

a first radar sensor coupled to the wicket and configured to capture first radar data describing one or more initial launch parameters of the cricket ball; and a second radar sensor coupled to the wicket and configured to capture second radar data describing one or more movement parameters of a bowler.

2. The sensor device of claim 1, wherein:

the wicket includes a stump;

the first image-capturing sensor, the second image-capturing sensor, and the first radar sensor are each coupled to a first surface of the stump and facing a batting end of the cricket field; and the second radar sensor is coupled to a second surface of the stump and facing the bowling end of the cricket field.

3. The sensor device of claim 2, wherein the first image-capturing sensor, the second image-capturing sensor, or the first radar sensor is triggered to capture sensor data based on the motion parameters of the bowler captured by the second radar sensor.

4. The sensor device of claim 1, wherein:

the wicket includes a stump; and the first image-capturing sensor is positioned at a top edge of a surface of the stump and facing a batting end of the cricket field.

5. The sensor device of claim 4, wherein the first image-capturing sensor includes a wide-angle lens.

6. The sensor device of claim 1, wherein the wicket includes a stump and the second image-capturing sensor comprises a pair of stereo image-capturing sensors positioned on one or more surfaces of the stump and facing a batting end of the cricket field.

7. The sensor device of claim 6, wherein each image-capturing sensor of the pair of stereo image-capturing sensors includes a telephoto lens.

8. The sensor device of claim 1, wherein the wicket includes a stump and the first radar sensor is positioned at a top edge of a surface of the stump facing a batting end of the cricket field.

9. The sensor device of claim 1, wherein the wicket includes a stump and the first image-capturing sensor, the second image-capturing sensor, and the first radar sensor are each positioned on the stump of the wicket.

10. The sensor device of claim 1, wherein the wicket includes a stump and the first image-capturing sensor, the second image-capturing sensor, or the first radar sensor is installed externally on a surface of the stump.

11. The sensor device of claim 1, wherein the first image-capturing sensor is pointed at a first direction and the second image-capturing sensor is pointed at a second direction, different from the first direction.

12. A system comprising:

a sensor device comprising:

a first image-capturing sensor coupled to a wicket positioned at a bowling end of a cricket field and configured to capture image data of an initial motion of a cricket ball;

a second image-capturing sensor coupled to the wicket and configured to capture image data of a trajectory and a flight path of the cricket ball;

a first radar sensor coupled to the wicket and configured to capture first radar data describing one or more initial launch parameters of the cricket ball; and a second radar sensor coupled to the wicket and configured to capture second radar data describing one or more movement parameters of a bowler a processor and memory coupled to the processor, wherein the processor is configured to:

process the image data captured by the first image-capturing sensor and the second image-capturing sensor; and process the first and second radar data captured by the first and second radar sensors, respectively.

13. The system of claim 12, wherein:

the wicket includes a stump;

the first image-capturing sensor, the second image-capturing sensor, and the first radar sensor are each coupled to a first surface of the stump facing a batting end of the cricket field; and the second radar sensor is coupled to a second surface of the stump facing the bowling end of the cricket field.

14. The system of claim 13, wherein the wicket includes a stump and the first image-capturing sensor, the second image-capturing sensor, or the first radar sensor is triggered to capture sensor data based on the motion parameters of the bowler captured by the second radar sensor.

15. The system of claim 12, wherein the wicket includes a stump and the first image-capturing sensor is positioned at a top edge of a surface of the stump and facing a batting end of the cricket field.

16. The system of claim 15, wherein the first image-capturing sensor includes a wide-angle lens.

17. The system of claim 12, wherein the wicket includes a stump and the second image-capturing sensor comprises a pair of stereo image-capturing sensors positioned on the stump and facing a batting end of the cricket field.

18. The system of claim 17, wherein each image-capturing sensor of the pair of stereo image-capturing sensors includes a telephoto lens.

19. The system of claim 12, wherein the wicket includes a stump and the first radar sensor is positioned at a top edge of a surface of the stump and facing a batting end of the cricket field.

20. The system of claim 12, wherein the wicket includes a stump and the first image-capturing sensors, the second image-capturing sensor, and the first radar sensor are each positioned on the stump of the wicket.

* * * * *